US006038717A

United States Patent [19]

Persson

[11] Patent Number: 6,038,717

[45] Date of Patent: Mar. 21, 2000

[54] DEVICE FOR A BED

[75] Inventor: Bror Persson, Kvidinge, Sweden

[73] Assignee: Errarp Innovation AB, Ängelholm, Sweden

[21] Appl. No.: 09/142,845

[22] PCT Filed: Mar. 20, 1997

[86] PCT No.: PCT/SE97/00463

§ 371 Date: Sep. 17, 1998

§ 102(e) Date: Sep. 17, 1998

[87] PCT Pub. No.: WO97/34560

PCT Pub. Date: Sep. 25, 1997

[30] Foreign Application Priority Data

Mar. 22, 1996 [SE] Sweden ..... 9601121

[51] Int. Cl.[7] ..... A61G 7/008; A61G 7/00

[52] U.S. Cl. ..... 5/607; 5/613

[58] Field of Search ..... 5/607, 613, 600, 5/715, 942

[56] References Cited

U.S. PATENT DOCUMENTS

| | | | |
|---|---|---|---|
| 2,112,702 | 3/1938 | Loibl | 5/613 |
| 3,013,281 | 12/1961 | Steiner | 5/607 |
| 4,375,706 | 3/1983 | Finnhult | 5/607 |
| 5,640,729 | 6/1997 | Marino | 5/607 |
| 5,699,566 | 12/1997 | Chuang | 5/613 |

FOREIGN PATENT DOCUMENTS

| | | | |
|---|---|---|---|
| 2154437A | 9/1985 | United Kingdom | 5/613 |
| 2231790A | 11/1990 | United Kingdom . | |
| WO 86/03663 | 12/1985 | WIPO | 5/607 |

*Primary Examiner*—Alexander Grosz
*Attorney, Agent, or Firm*—Burns, Doane, Swecker & Mathis, L.L.P.

[57] ABSTRACT

The invention concerns a device for a bed, particularly for handling e.g. hospitalized bedridden patients, for example when the patient's position needs to be changed, the bed to be made, or examinations to be carried out. The bed bottom of the bed is arranged to be shifted between an essentially horizontal position and two laterally pivoted positions, in which the bed bottom in the area of a lower longitudinal side (9) is angled for the purpose of forming a lateral contact area (13). The device comprises a plurality of abutment members (4) disposed in the area of the longitudinal sides of the bed, and it has an essentially elongate body (1) provided with projecting members (3) having a configuration complementary to that of the abutment members (4). The projecting members (3) and the abutment members (4) extend essentially in the transverse direction of the bed. The device also comprises a drive means (6) arranged to produce a relative movement between said projecting members (3) and said abutment members (4) for the purpose of producing said lateral contact area (13) and said bed bottom movements.

21 Claims, 3 Drawing Sheets

Fig. 2
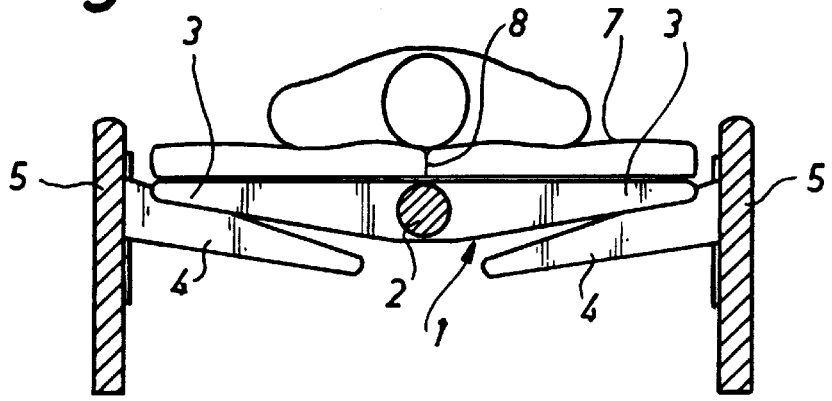
Fig. 3
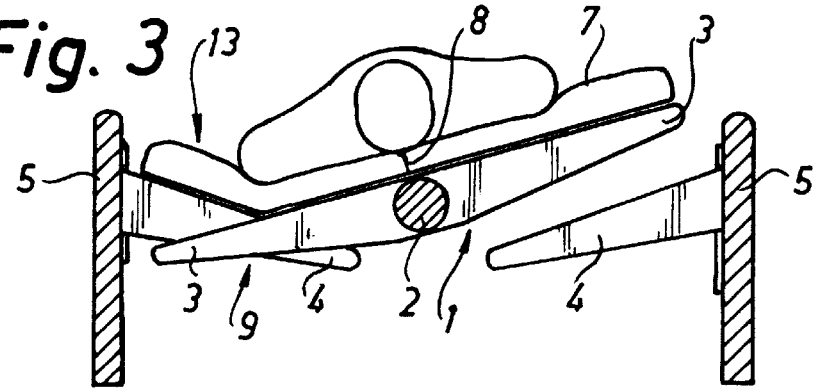
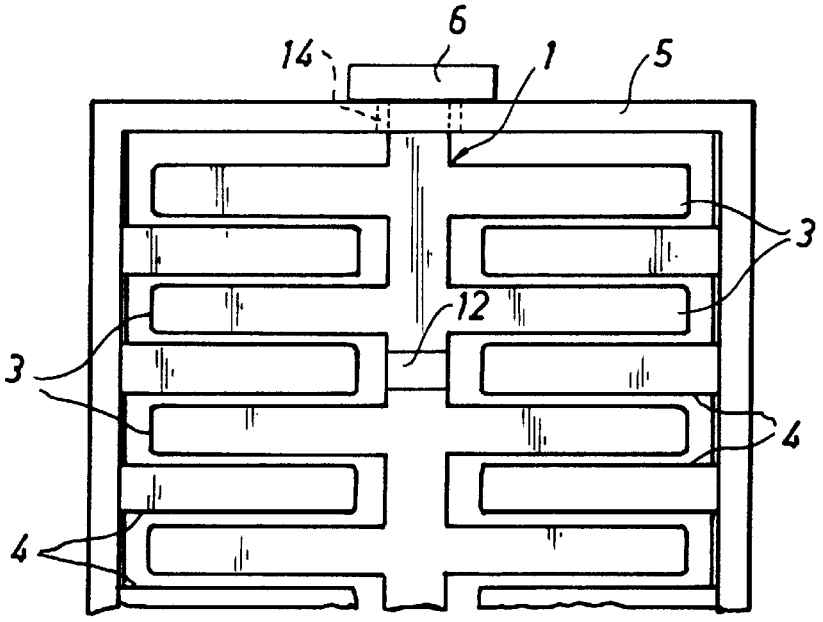
Fig. 4

DEVICE FOR A BED

The present invention relates to a device for a bed, and more precisely to a device designed to make the handling of e.g. hospitalized persons easier when for instance the patient's position needs to be changed, the bed be made or examinations of the patient be carried out.

Persons that are confirmed to bed often encounter problems in the circulatory system in the parts of the body that the weight thereof press against the bed bottom or against a support disposed on the bed bottom, such as a mattress. The problem is found particularly in the case of patients who are deeply unconscious, in coma, or disabled, etcetera, and produces discomfort and more often than not bed sores. To prevent such problems from developing, the bedridden patients may be turned over at regular intervals, such as once an hour, allowing the patient to assume a different posture, whereby different parts of the body will be exposed to pressure from its contact with the bed support. It is easily understood that such position changes in the case of e.g. disabled persons is hard work, requiring considerable skill and strength on the part of the nursing staff, and it is not unusual that two nurses are needed to change a patient's position in order to prevent the development of lifting strain induced injuries.

Also in order to make the bed and allow examinations of the bedridden patient to be performed it is sometimes necessary to change his or her position, which involves identical problems to those outlined above.

In order to alleviate these problems it is known to utilize various implements to facilitate e.g. position changes, bed-making, examinations, and so on.

GB 2 231 790 discloses one example of use of selectively inflatable and deflatable elongate cushions to effect such patient turning-over movements. However, devices of this kind require inflating and deflating mechanisms that generate noise in the environment of the bedridden person, and result in a comparatively expensive and complex structure.

SE 7800612-9 gives one example of a solution to the problem by providing on the long sides of the bed arm-supported roller rods between which e.g. a sheet extends. By manipulating the arms and thus the roller rods the position of a bedridden person may be altered. However, also this structure is comparatively expensive and complex, in addition to taking up considerable space.

A further example of a solution to the above problem is shown in U.S. Pat. No. 4,375,706. This device comprises a bed bottom which is divided into one middle section and two side sections which are pivotably attached to the middle secton at their inner longitudinal edges. The middle section is pivotable about a longitudinal central axis. The external longitudinal edges of the side sections are supported by a plurality of pivotally arranged link arms. The use of numerous movable parts, such as the sections and the link arms, results in a complex and consequently expensive structure. The link arms are located at the longitudinal edges of the bed and on account of their unprotected position they may be exposed to mechanical damage of a nature that affects the pivotal movements of the bed. In addition, the position of the link arms may also cause clamping injuries.

In GB 2 154 437, finally, is disclosed a further example of a solution to the above problem. The device in accordance with this publication comprises a lower bed portion and an upper bed portion, the latter having two parts. They are connected to the lower portion in such a manner as to be pivotable relatively thereto about axes normal to the longitudinal extent of the bed. Consequently, position change is possible only of the upper portion of the bed and this position change is restricted to the lengthwise direction. Each one of the upper bed portion parts consists of a plurality of elongate members arranged alternately across the area of the upper short end of the bed. The device disclosed in this publication thus does not allow change of the position of the legs of a patient occupying the bed, nor change of the position of the patient's body laterally.

One object of the present invention thus is to provide a device for a bed which while being of a simple, cheap, space-saving and reliable structure solves the above problems encountered when one wishes to laterally change the position of bedridden persons.

This and other objects are achieved in accordance with the present invention by means of a device for a bed as defined in the appended claims.

Presently advantageous embodiments of the present invention will be explained in more detail in the following with reference to the accompanying drawings, wherein:

FIG. 2 is a schematic cross-sectional view through a second embodiment of the inventive device, showing the bed bottom supporting a bedridden person in an essentially horizontal position.

FIG. 3 is a schematic cross-sectional view corresponding to FIG. 2 but showing the bed bottom in a laterally pivoted position and the bedridden person in a lateral position.

FIG. 4 is a partly broken schematical view of the device of FIGS. 2 and 3 as seen from above.

Figure 1:
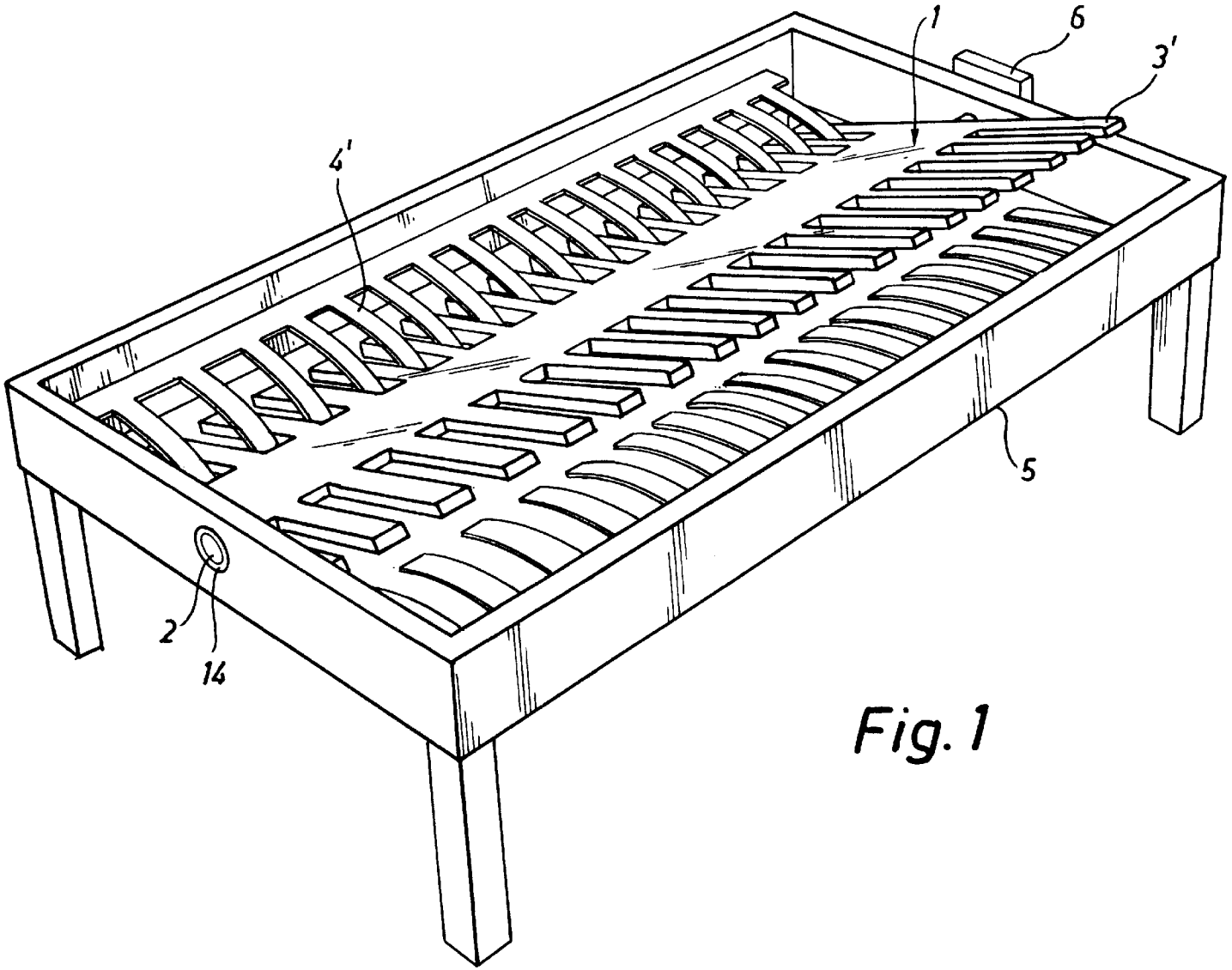
FIG. 1 is a schematical perspective view of a first embodiment of the inventive device.

The embodiment of the inventive object illustrated in FIGS. 2–4 comprises a body generally designated by reference 1. In accordance with the embodiment shown the body 1 comprises a shaft 2 which extends essentially in the longitudinal direction of the bed and which is pivotally mounted e.g. in the areas of its respective ends. As illustrated in FIG. 4, the shaft 2 may be pivotally mounted e.g. in the short ends of the frame structure 5 of the bed.

The body 1 also comprises a plurality of projecting members 3 extending essentially in the transverse direction of the bed and according to the shown embodiment, from an area adjacent the shaft 2 outwards towards the longitudinal sides of the bed.

The device likewise comprises a plurality of abutment members 4 disposed in the area of the longitudinal sides of the bed, and in accordance with the embodiment illustrated in FIGS. 2–4 they are fixedly secured to the longitudinal sides of the frame structure 5. Also the abutment members 4 extend essentially in the transverse direction of the bed. The abutment members 4 and the projecting members 3 are of complementary configuration and in accordance with the illustrated embodiment they are arranged alternately in the area of the longitudinal sides of the bed, as best illustrated in FIG. 4.

The device preferably includes a power operated drive means, which in accordance with the embodiment of FIGS. 2–4 is a rotating mechanism 6 arranged to turn the shaft 2 and thus the body 1 including the projecting members 3 thereon. In accordance with one preferred embodiment the drive mechanism 6 comprises a control means to control the rotary motion of the shaft 2. Parameters such as e.g. the maximum angular degree of the rotary movement and the rotational speed of the device may be controlled.

A support 7, for instance in the form of a mattress, is placed on top of the bed bottom and in accordance with a preferred embodiment it is removably attached to the body 1, preferably in the area of the shaft 2 and e.g. by means of attachment means 8 which are disposed in spaced apart relationship along the shaft 2.

The device functions as described in the following manner. Initially, the bed bottom and thus the bedridden person assume the essentially horizontal position illustrated in FIG. 2. By manual and/or mechanical operation of the drive means 6 rotary motion is transferred from shaft 2 to the projecting members 3. The rotary motion could be effected clockwise or anti-clockwise, as is the case of the rotary motion effected from the position of FIG. 2 to that of FIG. 3.

The rotary motion displaces the centre of gravity of the bedridden person to prevent bed sores from developing and to facilitate bed-making, examinations etcetera. During the rotary motion the projecting members 3 pass between the abutment members 4 in the area of a lower longitudinal side of the bed botten, generally designated by reference 9, with the result that the bed bottom and thus the support 7 will be angled in this area 9. The angle thus formed in the bed bottom produces a lateral contact area, generally designated by reference 13, in the bed bottom in area 9, whereby in the laterally pivoted or tilted position of the bed body the person occupying the bed will receive lateral support from the abutment members 4.

When a certain predetermined tilting angle of e.g. 10°–15° relatively to the horizontal plane is obtained it becomes easier to for instance make the bed by removing or inserting e.g. a sheet underneath the upper part of the bedridden person's body in the usual manner. Likewise, a clockwise tilting movement of the bed body may be initiated, either straight away or after a predetermined period of time, allowing the bedridden person to be turned e.g. from the "left side position" illustrated in FIG. 3 to a corresponding "right side position" wherein the right-hand longitudinal side of the bed bottom assumes a position below the left-hand one.

In accordance with the embodiment illustrated in FIG. 1, the abutment members 4' and the projecting members 3' are configured somewhat differently from those shown in FIGS. 2–4. FIG. 1 also illustrates in a perspective view the manner in which the projecting members 3' pass between the abutment members 4' as the frame is being tilted.

Figure 5:
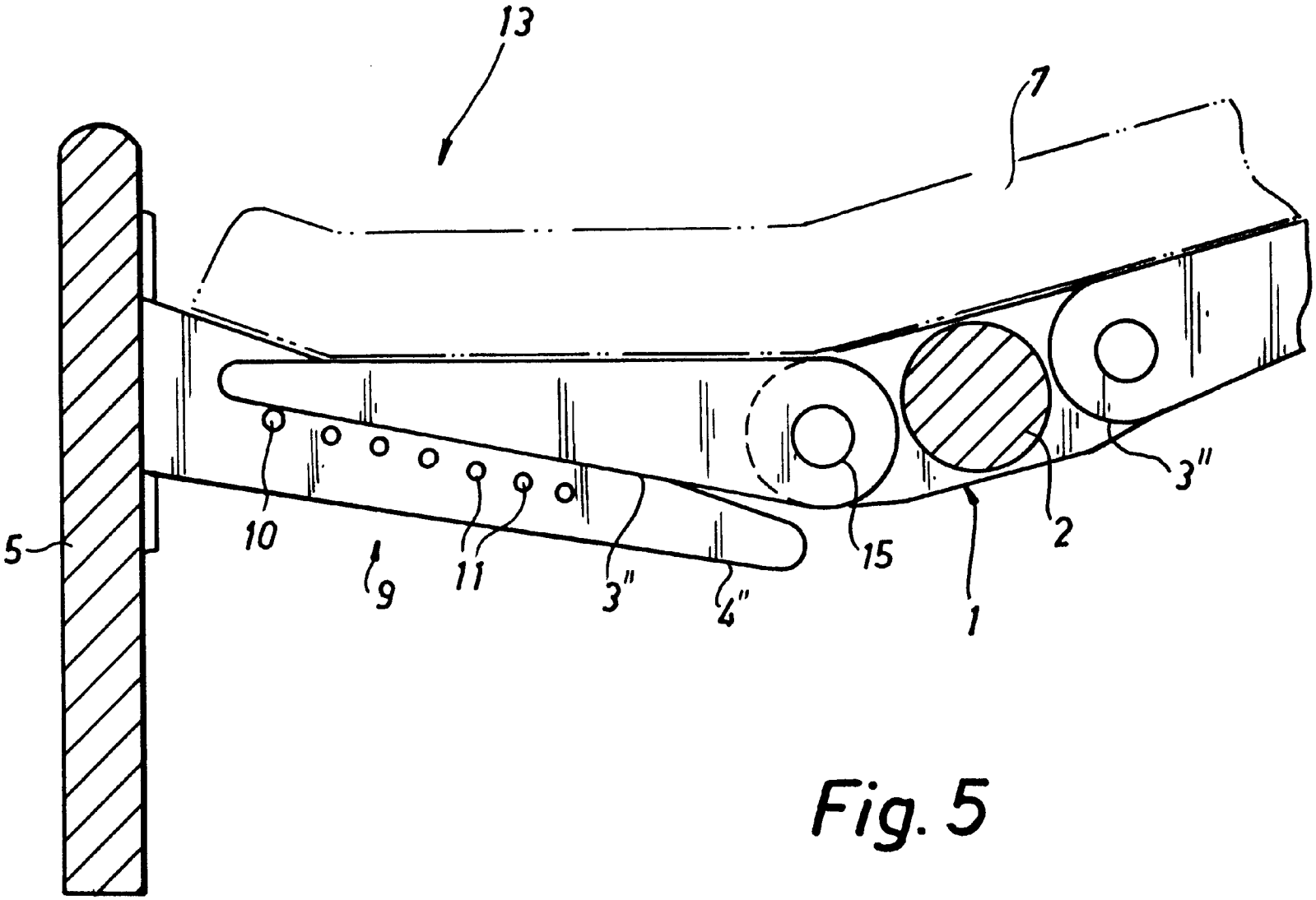
FIG. 5 is a partly broken schematical cross-sectional view of a third embodiment of the inventive bed bottom, showing the latter in a laterally pivoted position.

In accordance with one embodiment illustrated in FIG. 5, the abutment members 4" are formed with pins 10 and the projecting members 3" or parts thereof are attached to the body 1 by hinge means 15 allowing restricted pivotal movement of the members 3" relatively to the body. Upon tilting of the body, the projecting members 3" on a lower longitudinal side 9 of the body 1 will be brought into contact with the corresponding pins 10, said contact causing the projecting members 3" to pivot in the opposite direction to the direction of rotation of the shaft 2, to assume the position illustrated in FIG. 5. As a result, the bed bottom and thus the support 7 will be additionally angled in the area of its lower longitudinal side 9, increasing the comfort of the bedridden person.

In accordance with the embodiment of FIG. 5, the pins 10 are displaceably attached to the abutment members 4". They may for instance be arranged for insertion in different recesses 11 formed in the members 4". Acccording to this embodiment it becomes possible to control the amplitude of the oppositely directed pivotal movement of the projecting members 3" and, as a result, the configuration of the angled lower longitudinal side 9 of the bed bottom and thus of the support 7 may be adjusted. As is easily understood, the pins could equally well be positioned on the projecting members 3" in order to cause the projecting members 3" to pivot in a direction opposite to the rotary motion of the shaft 2.

In accordance with one embodiment the device is provided with at least one hinge means 12, shown schematically in FIG. 4, of a kind allowing the bed to be angled in the longitudinal direction thereof between an essentially horizontal position and an angled position (not shown), in which e.g. the head end or the foot end of the bed bottom is raised or lowered. In accordance with one embodiment the hinge means 12 is configured as a universal joint in the area of the shaft 2, the hinge means 12 being formed with a locking mechanism to secure the structure and thus the shaft 2, in the essentially horizontal position. In accordance with another embodiment, the body 1 is sectionalized lengthwise, and hinge means 12 are disposed intermediate the various sections to allow the bed to be angled in its lengthwise direction.

In accordance with one embodiment the locking mechansim of the hinge means 12 is arranged to allow the bed to be so angled only when the bed bottom is not tilted laterally, in order to avoid interengagement between the projecting members 3 and the abutment members 4 as the body is angled with the aid of the hinge means 12.

In accordance with one embodiment (not illustrated) the abutment members 4 are movable with respect to the longitudinal sides of the bed in order to provide additional adjustment possibilities of the device. The abutment members 4 may be movable vertically to set the point at which the lateral contact area 13 of the abutment members 4 is to be built up during the tilting movement, and/or the abutment members 4 may be mounted for pivotal movement about a pivot point for adjustment of the inclination of the abutment members 4, and thus that of the lateral contact area 13, relatively to the horizontal plane (one example of the abutment member inclination appears from FIGS. 2 and 3).

The inventive device provides a simple and cheap structure of a sturdy and space-saving design. This is achieved owing to the basic inventive idea of utilizing the projecting members 3, 3', 3" and the abutment members 4, 4', 4" and of providing for relative movement between the projecting members 3, 3', 3" and the abutment members 4, 4', 4". In accordance with the embodiments shown, this relative movement is a rotary motion and causes the bed bottom to shift from the essentially horizontal position to said laterally tilted positions, thus producing said lateral contact area 13 in the area of a lower longitudinal side 9 of the bed bottom.

As is easily understood some deviations from the described embodiments are possible. Thus, oppositely positioned abutment members 4, 4', 4"0 need not be separate elements as illustrated in the drawing figures but may equally well be interconnected by web portions extending between the members underneath the body 1. The above-mentioned relative movement could likewise partly or wholly be achieved without rotating the body but instead by vertically displacing the abutment members and possibly also the projecting members. For instance, the abutment members and the projecting members on one side could be lowered, while the abutment members on the opposite side retain their positions. In this case the abutment members on the latter side will carry the support in the area of the upper longitudinal side of the bed bottom when the projecting members pass between these abutment members, a movement which brings about essentially the same "change-of-position effect" as the pivotal movement of the projecting members 3 of the embodiments described above with reference to the various drawing figures. In order to produce the lateral contact area 13 in the area of the lower longitudinal side 9 of the bed bottom, for instance the downwardly directed lower movement of the abutment members of the first-mentioned side could be stopped while the projecting members are lowered somewhat further. All varieties and modifications that are comprised by the basic inventive idea should, however, be regarded to be within the scope of the appended claims.

What is claimed is:

1. A bed comprising:

a bed bottom arranged to be shifted between an essentially horizontal position and two laterally pivoted positions, in which the bed bottom in an area of one of the lower longitudinal sides of the bed is angled for the purpose of forming a lateral contact area, said bed bottom including a plurality of abutment members disposed in the area of the longitudinal sides of the bed, and an essentially elongate body provided with projecting members having a configuration complementary to that of the abutment members, said projecting members and said abutment members extending essentially in a transverse direction of the bed, and a drive means arranged to produce a relative movement between said projecting members and said abutment members for the purpose of producing said lateral contact area and said bed bottom movements.

2. A bed as claimed in claim 1, wherein the projecting members and the abutment members are alternately disposed in the area of the longitudinal sides of the bed.

3. A bed as claimed in claim 2, wherein the body is mounted for rotary motion about a rotational shaft extending essentially in a lengthwise direction of the bed, said relative movement being achieved by tilting the body such that said projecting members completely or partly pass between the abutment members in the area of one of the lower longitudinal sides of the bed bottom upon said body tilting movement in order to produce said lateral contact area of said bed bottom.

4. A bed as claimed in claim 3, wherein the tilting movement of said body is produced by a rotating mechanism.

5. A bed as claimed in claim 4, wherein the rotating mechanism comprises control means to control the maximum angular degree and the rotating speed of the tilting movement.

6. A bed as claimed in claim 2, further comprising at least one hinge means such that at least part of the bed bottom may be set at an angle in a lengthwise direction of the bed, between an essentially horizontal position and an inclined position, wherein at least one of a head end and a foot end of the bed bottom is raised or lowered.

7. A bed as claimed in claim 1, wherein the body is mounted for rotary motion about a rotational shaft extending essentially in a lengthwise direction of the bed, said relative movement being achieved by tilting the body such that said projecting members completely or partly pass between the abutment members in the area of one of the lower longitudinal sides of the bed bottom upon said body tilting movement in order to produce said lateral contact area of said bed bottom.

8. A bed as claimed in claim 7, wherein pins are provided which upon said tilting movement cause contact between said projecting members and said abutment members, and in that the projecting members are hingedly attached to the body in such a manner that upon said contact they pivot in the opposite direction to the tilting movement of said body.

9. A bed as claimed in claim 8, wherein said pins are movably arranged on at least one of the projecting members and the abutment members in order to produce adjustable pivoting movements of said projecting members relatively to the body.

10. A bed as claimed in claim 9, wherein the tilting movement of said body is produced by a rotating mechanism.

11. A bed as claimed in claim 10, wherein the rotating mechanism comprises control means to control the maximum angular degree and the rotating speed of the tilting movement.

12. A bed as claimed in claim 9, further comprising at least one hinge means such that at least part of the bed bottom may be set at an angle in a lengthwise direction of the bed, between an essentially horizontal position and an inclined position, wherein at least one of a head end and a foot end of the bed bottom is raised or lowered.

13. A bed as claimed in claim 8, wherein the tilting movement of said body is produced by a rotating mechanism.

14. A bed as claimed in claim 13, wherein the rotating mechanism comprises control means to control the maximum angular degree and the rotating speed of the tilting movement.

15. A bed as claimed in claim 8, further comprising at least one hinge means such that at least part of the bed bottom may be set at an angle in a lengthwise direction of the bed, between an essentially horizontal position and an inclined position, wherein at least one of a head end and a foot end of the bed bottom is raised or lowered.

16. A bed as claimed in claim 3, wherein the tilting movement of said body is produced by a rotating mechanism.

17. A bed as claimed in claim 16, further comprising at least one hinge means such that at least part of the bed bottom may be set at an angle in a lengthwise direction of the bed, between an essentially horizontal position and an inclined position, wherein at least on of a head end and a foot end of the bed bottom is raised or lowered.

18. A bed as claimed in claims 16, wherein the rotating mechanism comprises control means to control such parameters as the maximum angular degree, the rotating speed and the like of the tilting movement.

19. A bed as claimed in claim 7, further comprising at least one hinge means such that at least part of the bed bottom may be set at an angle in a lengthwise direction of the bed, between an essentially horizontal position and an inclined position, wherein at least one of a head end and a foot end of the bed bottom is raised or lowered.

20. A bed as claimed in claim 1, further comprising at least one hinge means such that at least part of the bed bottom may be set at an angle in a lengthwise direction of the bed, between an essentially horizontal position and an inclined position, wherein at least one of a head end and a foot end of the bed bottom is raised or lowered.

21. A bed as claimed in claim 20, wherein the hinge means comprises a locking mechanism preventing such angled position when the bed bottom assumes its laterally titled position.

* * * * *